US006112801A

United States Patent [19]

Daniels et al.

[11] Patent Number: 6,112,801

[45] Date of Patent: Sep. 5, 2000

[54] PENDANT FINIAL

[75] Inventors: James L. Daniels, Freeport; Jane E. Parks, Lena, both of Ill.

[73] Assignee: Newell Window Furnishing, Inc., Freeport, Ill.

[21] Appl. No.: 09/351,836

[22] Filed: Jul. 13, 1999

[51] Int. Cl.[7] ..... A47H 1/00

[52] U.S. Cl. ..... 160/330; 160/38

[58] Field of Search ..... 160/330, 38, 39, 160/123, 124, 126, 84.01, 405; 211/105.1; 16/87 R, 87.2

[56] References Cited

U.S. PATENT DOCUMENTS

| | | | |
|---|---|---|---|
| 3,164,352 | 1/1965 | Weaver | 160/330 X |
| 3,693,210 | 9/1972 | MacFarlane et al. | 160/38 X |
| 3,890,800 | 6/1975 | Montague | 63/13 |
| 4,085,480 | 4/1978 | Kromm et al. | 160/38 |
| 4,147,199 | 4/1979 | Cameron | 160/330 |
| 5,615,721 | 4/1997 | Winter | 160/38 |
| 5,642,595 | 7/1997 | Daniels | 160/330 X |
| 5,670,221 | 9/1997 | Bried et al. | 160/314 X |
| 5,678,703 | 10/1997 | Sawyer | 211/105.1 |

*Primary Examiner*—David M. Purol
*Attorney, Agent, or Firm*—Foley & Lardner

[57] ABSTRACT

A window covering support system is disclosed, and includes a rod adapted to support a window covering and for being secured to a wall adjacent a window, a finial configured to be secured to an end of the rod and to suspend a pendant, and a pendant configured to be attached to and suspended from the finial. Also disclosed is a coupling device for coupling a pendant to a horizontally disposed window covering support rod, the coupling device configured as a finial and including a coupler adapted to be secured to an end of the rod and for suspending an attached pendant by gravity. Also disclosed is a pendant configured for being suspended by gravity from one of an eye and a hook of a finial of a horizontally disposed window covering support rod, and further configured to swing freely about the one of the eye and the hook. Also disclosed is a method for attaching a pendant to an end of a window covering support rod, the method including the steps of securing a finial to the end of the rod and suspending the pendant from the finial.

22 Claims, 3 Drawing Sheets

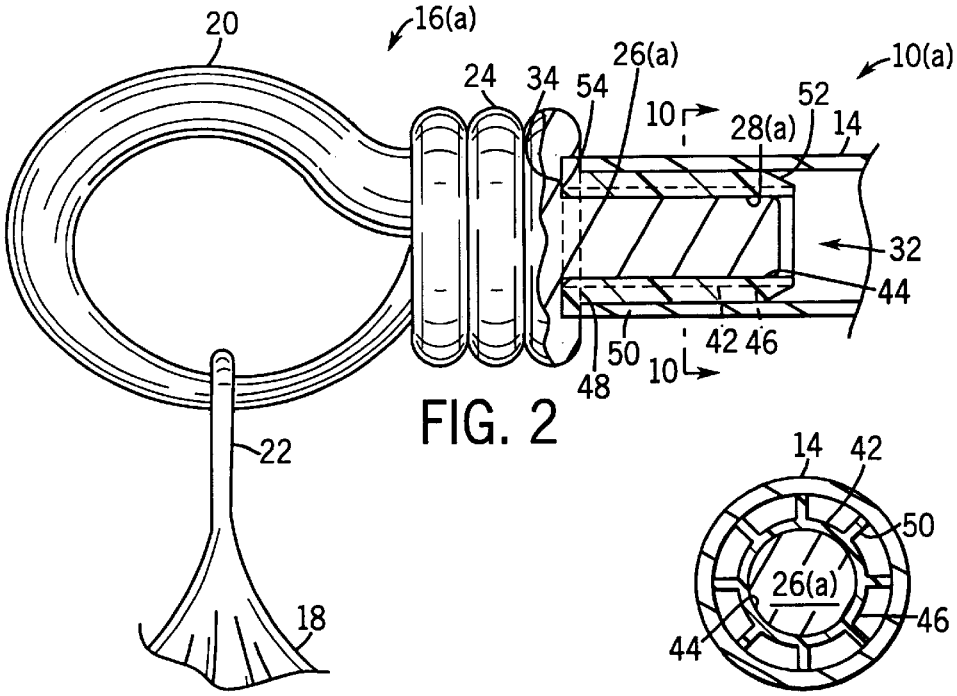
FIG. 2
FIG. 10
FIG. 3
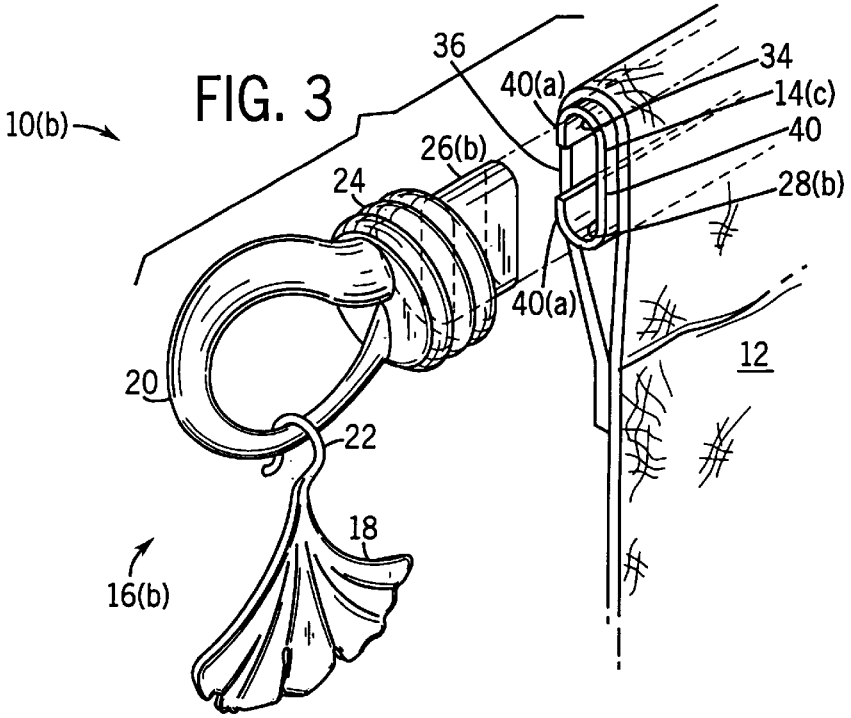

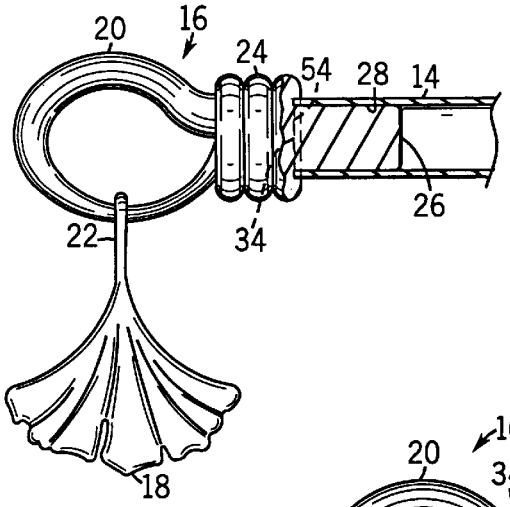
FIG. 4
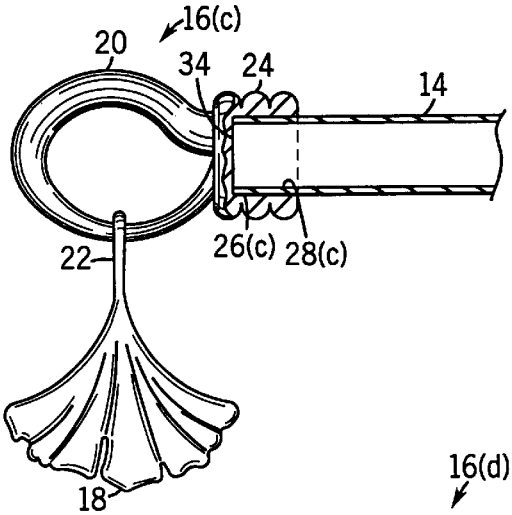
FIG. 5
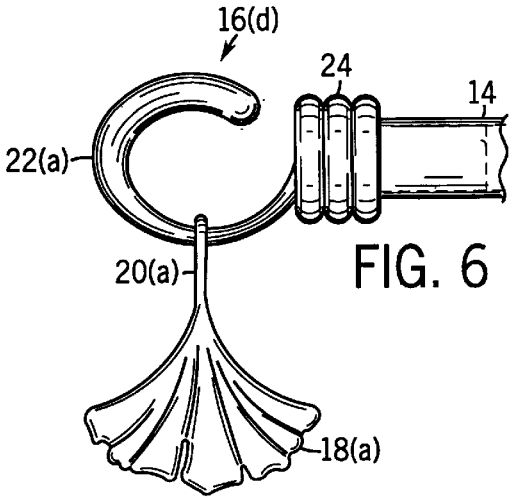
FIG. 6
FIG. 7
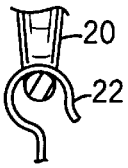
FIG. 8
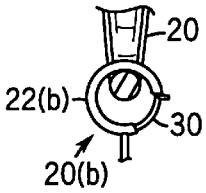
FIG. 9
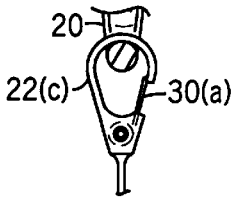

PENDANT FINIAL

FIELD OF THE INVENTION

The present invention relates generally to window covering support systems. It relates more particularly to pendants hanging from the ends of rods of such systems.

BACKGROUND OF THE INVENTION

Window coverings (e.g., drapes and curtains), as well as wall hangings (e.g., tapestries, decorative rugs, banners, artworks) are often suspended from, and thereby supported by, horizontally disposed rods. The rods are typically spaced a small distance from a wall including the window, or to which the wall hanging is to be secured, by brackets used for spacing the rod as well as for securing the rod to the wall. First and second ends of such rods are typically flush with an outer edge of each of the corresponding first and second brackets, or project slightly beyond the outer edges of the brackets.

The rods are typically manufactured of metals (e.g., enameled steel, plain or finished aluminum, brass or bronze, etc.) or of plastics. When they are cut to length in manufacturing or in field installation, they are generally deburred but may still include corners or edges sharp enough to snag, and even damage, the fabric or other material of the wall covering or hanging. Moreover, a cut end of a rod may appear unattractively unfinished in many styles of decor.

For these reasons, decorative end pieces, termed "finials" and configured to be unlikely to snag window covering material, are often provided to be affixed to both ends of a rod.

It is known to provide such finials in various designs and of various sizes and degrees of aesthetics, to be secured to ends of a rod by press fits or by threaded or unthreaded (e.g., spring pins) fasteners. It is also known to provide various kits for sale, each including generally the same style of rod (e.g., plain, fluted, or otherwise patterned) and finials of a particular style (e.g., Romanesque, gothic, colonial, sport-oriented, etc.) to assist in complementing the decor of a particular room and/or wall covering or hanging.

It would be advantageous to provide for a window covering support system to have finials which can be provided with a variety of decorative members. It would also be advantageous to provide for the decorative members of such a window covering support system to be easily and quickly replaceable by, e.g., an unskilled homeowner, without the use of tools. It would also be advantageous to provide for the decorative members of such a window covering support system to be pendant (i.e., hanging vertically by gravity and freely swinging) to enhance the aesthetic value of the window covering support system.

SUMMARY OF THE INVENTION

It is an object of the present invention to provide a decorative finial for a rod of a window covering support system. It is a further object of the present invention to provide such a finial which may be easily reconfigured to another style of decor by an unskilled person without the use of tools.

The present invention relates to a window covering support system including a rod adapted to support a window covering and for being secured to a wall adjacent window, a finial configured to be secured to an end of the rod and to suspend a pendant, and a pendant configured to be attached to and suspended from the finial.

The present invention also relates to a coupling device for coupling a pendant to a horizontally disposed window covering support rod, the coupling device configured as a finial and including a coupler adapted to be secured to an end of the rod and for suspending an attached pendant by gravity.

The present invention also relates to a pendant configured for being suspended by gravity from one of an eye and a hook of a finial of a horizontally disposed window covering support rod, and further configured to swing freely in at least one plane about the one of the eye and the hook.

The present invention also relates to a method for attaching a pendant to an end of a window covering support rod, the method including the steps of securing a finial to the end of the rod and suspending the pendant from the finial.

DESCRIPTION OF THE DRAWINGS

A full understanding of the invention may be gained from the appended Drawings taken in conjunction with the Detailed Description below, wherein like reference numerals refer to like parts.

FIG. 2 is a fragmentary sectional front elevation of an alternative embodiment of the window covering support system.

FIG. 3 is a fragmentary, exploded perspective view of an alternative embodiment of the window covering support system.

FIG. 4 is a fragmentary sectional front elevation of an alternative embodiment of the window covering support system.

FIG. 5 is a fragmentary sectional front elevation of an alternative embodiment of the window covering support system.

FIG. 6 is a fragmentary sectional front elevation of another alternative embodiment of the window covering support system.

FIG. 7 is a fragmentary side elevation of a preferred embodiment of a suspending member of the window covering support system, taken at line 7—7 in FIG. 1.

FIG. 8 is a fragmentary side elevation of an alternative embodiment of a suspending member of the window covering support system.

FIG. 9 is a fragmentary side elevation of another alternative embodiment of a suspending member of the window covering support system.

FIG. 10 is an end sectional view taken at line 10—10 of FIG. 2.

DETAILED DESCRIPTION OF EXEMPLARY EMBODIMENTS

Figure 1:
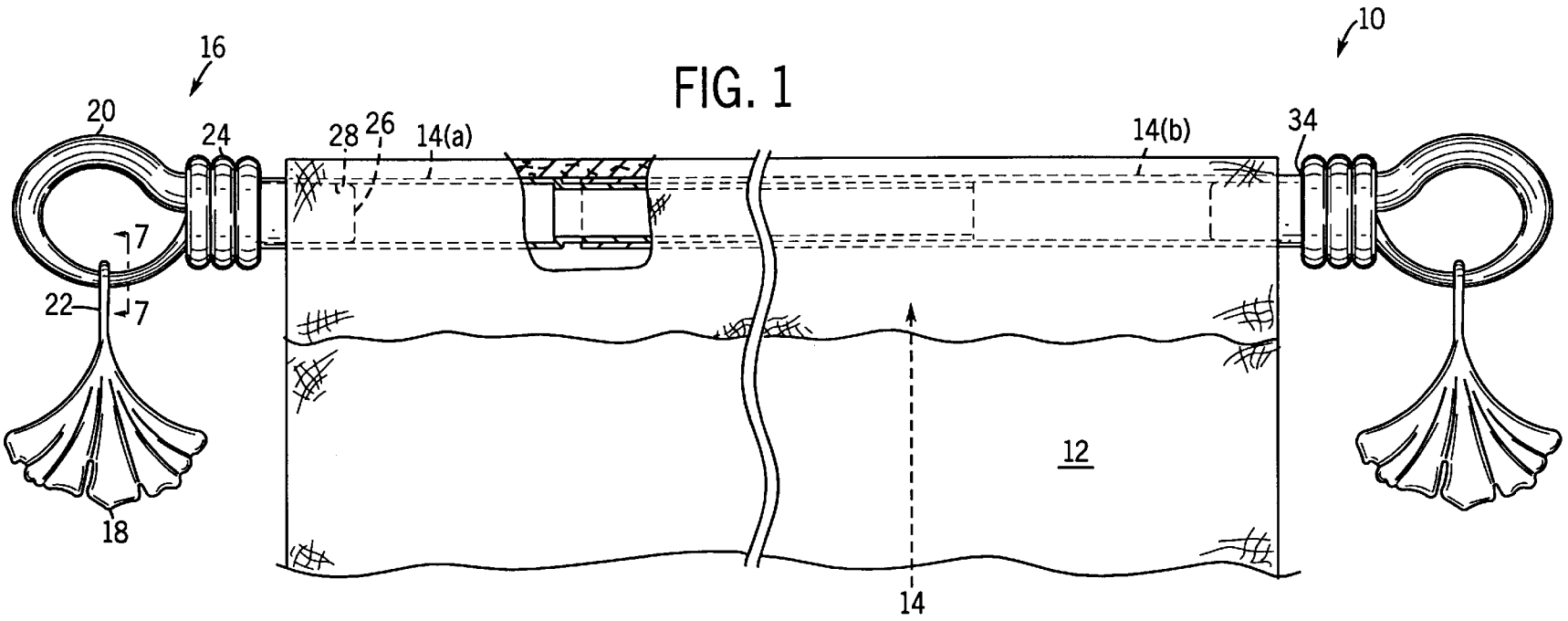
FIG. 1 is a broken front elevation of a preferred embodiment of a window covering support system.

FIG. 1 shows a preferred embodiment of a window covering support system 10, typically horizontally disposed to suspend a window covering 12 (e.g., one or more drapes, curtains, etc.) and mounted to a wall or other vertical structure (not shown) by conventional brackets (not shown) above a window or other opening (not shown) in the wall. Window covering support system 10 is not limited to support of window coverings, but may be used for portieres, wall hangings, and similar devices.

Wall covering support system 10 includes a rod 14 having first and second ends 34, at least one coupling device (shown as a finial 16) configured to engage end 34 and to couple a pendant 18 to end 34 of rod 14, and at least one pendant 18 configured to engage finial 16. Rod 14, finial 16, and pendant 18 may be constructed of any combination of appropriate materials (e.g., metal, plastic, wood, etc.) and may be provided with any of the conventional finishes known to those of skill in the art (e.g., natural, clear-coat, paint, plating, anodizing, gold leaf, etc.).

Rod 14 may be of any of the many configurations known to those of skill in the art; e.g., a wood dowel, one or more lengths of solid metal or plastic bar (e.g., round, hexagonal, square), or one or more lengths of metal or plastic tube. Other styles of rod are equally applicable; e.g., a telescoping rod as shown in FIG. 1, a tube having an obround cross section as shown in FIG. 3, etc. Rod 14 is typically fabricated of, or adapted to, a length equaling or slightly exceeding the operative width of wall covering 12, and fabricated of a cross sectional shape and width providing a sectional modulus sufficient to preclude excessive deflection under the load of window covering 12.

As referred to above, rod 14 may be configured to be adjustable in length; e.g., as one member 14(*a*) at least partially housed within, and slidably adjustable in position 25 with respect to, a second, tubular member 14(*b*) (i.e., telescoped as in FIG. 1). Member 14(*a*) may be provided a widening at its outermore end as shown in FIG. 1, the widening being of substantially the same inside diameter as that of member 14(*b*), so that both finials 16 may have projections 26 of substantially equal diameters.

In the instance of a telescoping rod 14 which does not include a widening (not shown), first and second finials 20 may be provided first and second projection 26 diameters to fit rod 14(*a*) and 14(*b*) inside diameters, respectively In an alternative embodiment (not shown) including bushings, a first bushing may be provided a first outer diameter to fit rod 14(*a*) inside diameter and a second bushing may be provided a second outside diameter to fit rod 14(*b*) inside diameter. In other alternative embodiments (not shown), a telescoping rod 14 may include a center portion of a first inside or outside diameter and end portions of substantially similar outside or inside diameters (respectively), so that both end portions telescope within or about (respectively) the center portion and have substantially equal end 34 inside diameters for similar recesses 28, thereby allowing use of substantially identical finial projection 26 diameters or bushing 32 outside diameters 46.

In the embodiments shown in FIGS. 1 through 5, finial 16 includes an eye 20 which, while decorative in itself, is additionally useful for suspending decorative pendant 18 by a hook 22. Eye 20 may be of varying section diameter as shown, or may be of substantially constant section diameter (not shown). In a preferred embodiment, pendant 18 thus hangs by gravity from finial 16 and freely swings in at least one vertical plane to a position disposed below finial 16. The decorative appearance of window covering support system 10 may thereby be changed by simply lifting a first pendant (e.g., of the leaf design 18 shown in FIGS. 1–6) from eye 20, and hooking a second pendant (not shown; e.g., of acorn, grape cluster, miniature soccer ball, etc. motif) to eye 20. Pendant 18 may of course be of virtually any design desired, and is shown in the form of a leaf merely for illustration of an example of a typical embodiment of pendant 18.

Finial 16 typically includes a boss portion 24, which serves as a stop for window covering 12 as well as functioning as a transition for a projection 26 or a housing for a recess 28 of finial 16 to engage end 34 of rod 14. Finial 16 includes either of projection 26 or recess 28, while rod 14 includes the other of projection 26 or recess 28, which recess 28 may be the bore of a tubular rod 14 or of a bushing 32 (shown in FIGS. 2 and 10). The outer surface of a projection may be longitudinally ridged (not shown) to reduce the assembly force required to press finial 16 and rod 14 together and to expand the manufacturing dimensional tolerance ranges of diameters of the projection and of recess 28, for economy of manufacturing. Alternatively, finial 16 may be secured to end 34 of rod 14 by fasteners (not shown; e.g., machine screw, set screw, pin) with or without a supplementary press fit, or may be clamped by one clamping devices known to those of skill in the art (not shown; e.g., taper-lock bushings), or may be secured by an adhesive.

FIGS. 1–4, 6, and 10 show window covering support system 10 in which projection 26 is associated with finial 16. In a preferred embodiment, a finial 16 including a projection 26 also includes a shallow recess 54 for receiving end 34 of rod 14.

FIGS. 2 and 10 depict a preferred embodiment of window covering support system 10(*a*), in which a bushing 32 adapts a projection 26(*a*) of a finial 16(*a*) to rod 14. Bushing 32 includes a recess 28(*a*) shown as a bore, or an inner diameter 44. Bushing 32 also includes a cylindrically configured body 42 having an inner diameter 44 and an outer diameter 46. Inner diameter 44 is made of a size to receive projection 26(*a*), preferably in a press fit, and outer diameter 46 is made of a size to be received by an inner diameter of tubular rod 14, again preferably in a press fit. Bushing 32 includes an integral flange 48 (at an end opposite an insertion end) which bears upon end 34 of rod 14 to prevent bushing 32 from being pushed too far within rod 14, and further includes a narrowing at the insertion end to facilitate the engaging of bushing 32 with rod 14. The narrowing may typically be a rounding or a tapering of the insertion end as is well known to those of skill in the art, and is shown in FIG. 2 as a conventional lead-in chamfer 52.

In a preferred embodiment, bushing 32 further includes a plurality of radially disposed members upon either or both of internal diameter 44 and/or outer diameter 46, those members shown in FIG. 10 as outwardly extending fins 50 radially and longitudinally disposed upon outer diameter 46. Deflection of fins 50 upon insertion of bushing 32 into rod 14 increases predictability, and therefore control, of the force required to press bushing 32 into rod 14 while allowing a relaxation of manufacturing dimensional tolerances of projection 26 and/or recess 28 for economy of manufacturing. Bushing 32 is preferably molded of a plastic; e.g., a low-density polyethylene.

Referring now to FIG. 3, an alternative embodiment of window covering support system 10(*b*) includes a finial 16(*b*) which is shown about to be installed to a rod 14(*c*). Rod 14(*c*) is shown of tubular construction and obround cross section, and is provided a slit 36 located at least in the regions of ends 34. One wall 40 is slit so that the remaining wall portions 40(*a*) function as cantilevered leaf springs to better grip projection 26(*b*) of finial 16(*b*), and again allow a relaxation of manufacturing dimension tolerances for economy of manufacturing.

FIGS. 4, 5, and 6 depict several of many possible embodiments of interface between rod 14, finial 16, and pendant 18. In FIG. 4, finial 16 includes projection 26 configured to be pressed into recess 28 within end 34 of tubular rod 14, as well as eye 20 for suspending pendant 18 via hook 22 of pendant 18. A recess 54 seats end 34 within boss 24.

In FIG. 5, a finial 16(*c*) includes eye 20 and a recess 28(*c*) for receiving end 34 of rod 14, end 34 serving as a projection 26(*c*) for engaging recess 28(*c*) of finial 16(*c*) in a press fit.

In FIG. 6, a finial 16(*d*) engages rod 14 as in FIG. 4, but includes a hook 22(*a*) instead of an eye. Pendant 18 may include hook 22 (both shown in FIGS. 1–5 and 7) as in the preceding embodiments to engage hook 22(*a*) of finial 16(*d*), or a pendant 18(*a*) may include an eye 20(*a*) to engage hook 22(*a*).

FIGS. 7, 8, and 9 show several of many possible embodiments of hook 22, which in a preferred embodiment is associated with pendant 18 (shown in FIGS. 1–5) but may alternatively be associated with finial 16. FIG. 7 shows a conventional hook, easily formed of metallic wire or molded in various plastics. FIGS. 8 and 9 show a few of the many typical means known to those of skill in the art for retaining pendant 18 to finial 16 (both shown in FIGS. 1–6).

FIG. 8 depicts a fabricated eye 20(*b*) including a tubular hook 22(*b*), an arcuately telescoping closure member 30 partially housed within tubular hook 22(*b*), and an internal spring (not shown) disposed within tubular hook 22(*b*) to maintain telescoping closure member 30 extended and thereby hook 22(*b*) closed in the form of eye 20(*b*), a conventional construction generally widely known for, e.g., key rings.

FIG. 9 depicts another widely known conventional construction of a hook 22(*c*) having a closure member 30(*a*), which is urged by a spring (not shown) to a closed position as shown. In one common form, such a hook includes a closure member which is itself a cantilevered leaf spring.

In alternative embodiments (not shown), the coupling is formed as part of the rod proximate the end of the rod. In one alternative embodiment, an aperture projects through a wall of the rod near an end of the rod and a hook, or comparable feature, of a pendant is inserted through the aperture to suspend the pendant from the rod. In another alternative embodiment, a narrowing of the rod is provided near an end of the rod and a pendant is hooked over the narrowing. In other alternative embodiments, a pendant is provided an integral coupling portion for pendant attachment to a rod; e.g., a beaded chain. All such alternative embodiments are configured for the pendant to freely swing in at least one vertical plane.

While the embodiments illustrated in the Figures and described above are presently preferred, it should be understood that these embodiments are offered only as examples. For further example, many other forms of rod cross section, hook closure, decorative pendant design, etc. are well known to those of skill in the art. Other variations of construction rather than invention will be obvious to those skilled in the art, but are nonetheless within the scope and spirit of the present invention. The invention is not limited to any particular embodiment, but encompasses various modifications and differences of construction that fall within the scope and spirit of the appended claims.

What is claimed is:

1. A window covering support system, comprising:

a rod including a first end and a second end, the rod adapted to support a window covering having a top portion supported by the rod and a first end and a second end;

a pair of finials, each finial secured to each respective end of the rod; and a pair of pendants, each pendant suspended from each respective finial and located outwardly of the respective end of the rod and outwardly of the respective end of the window covering.

2. The window covering support system of claim 1, wherein the rod is horizontally disposed adjacent the window and the pendant is vertically disposed by gravity from the finial, the pendant and the finial configured for the pendant to swing freely with respect to the finial.

3. The window covering support system of claim 1, wherein the end of the rod and a corresponding end of the finial are configured for a press fit of the finial to the end of the rod.

4. The window covering support system of claim 1, wherein one of the rod and the finial includes a recessed portion and the other of the rod and the finial includes a projecting portion dimensioned for interactive, coactive engagement.

5. The window covering support system of claim 1, wherein:

the rod is configured as a tubular member having an inner surface and an outer surface; and the finial includes a tubular portion configured to engage at least one of the inner and outer surfaces of the tubular rod.

6. The window covering support system of claim 1, wherein one of the finial and the pendant includes an eye and the other of the finial and the pendant includes a hook configured to engage the eye.

7. The window covering support system of claim 1, wherein each pendent is suspended in a first plane extending vertically through a longitudinal axis of the rod.

8. The window covering support system of claim 7, wherein each pendent is free to swing in a second plane perpendicular to the first plane.

9. A window covering support system, comprising:

a rod adapted to support a window covering and for being secured to a wall adjacent a window;

a finial configured to be secured to an end of the rod and to suspend a pendant; and a pendant configured to be suspended from the finial;

wherein one of the rod and the finial includes a recessed portion and the other of the rod and the finial includes a projecting portion dimensioned for interactive, coactive engagement, and wherein one of the rod and the finial includes at least one longitudinally disposed slot interrupting a wall of the corresponding tube, the remaining wall of the tube thereby functioning as a spring to enhance frictional engagement of the tube with the other of the rod and the finial.

10. A window covering support system, comprising:

a rod adapted to support a window covering and for being secured to a wall adjacent a window;

a finial configured to be secured to an end of the rod and to suspend a pendant; and a pendant configured to be suspended from the finial;

wherein one of the finial and the pendant includes an eye and the other of the finial and the pendant includes a hook configured to engage the eye, the hook including a closure portion for selectively opening and closing the opening of the hook and the pendant is thereby held captive to the finial.

11. A coupling device for coupling a pendant to a horizontally disposed rod for supporting a window covering, the coupling device configured as a finial and including a coupler secured to an end of the rod, the pendant being releasably suspended from the coupler outwardly of the end of the rod, and outwardly of an end of the window covering.

12. The coupling device of claim 11 configured for a press fit to the end of the rod.

13. The coupling device of claim 11, further including one of a recessed portion and a projecting portion, the rod including the other of the recessed portion and the projecting portion, the recessed portion and the projecting portion dimensioned for interactive, coactive engagement.

14. The coupling device of claim 11, further including a tubular portion configured to engage at least one of the inner and outer surfaces of a rod having a tubular cross section including inner and outer surfaces.

15. The coupling device of claim 11, further including one of an eye and a hook for suspending a pendant, the pendant provided with the other of the eye and the hook.

16. The coupling device of claim 11, wherein the pendent is free to swing in a first plane perpendicular to a second plane including a longitudinal axis of the rod.

17. A coupling device for coupling a pendant to a horizontally dispose window covering support rod, the coupling device configured as a finial and including a coupler adapted to be secured to an end of the rod and for suspending an attached pendant by gravity in vertical disposition, the coupler and the pendant configured for the pendant to swing freely with respect to the coupler;

the coupler including one of a recessed portion and a projecting portion, the rod including the other of the recessed portion and the projecting portion, the recessed portion and the projecting portion dimensioned for interactive, coactive engagement; and at least one longitudinally disposed slot interrupting a wall of the tubular portion, the remaining portion of the wall thereby functioning as a spring to enhance frictional engagement of the coupling device with the rod.

18. A method for attaching a pendant to an end of a horizontal rod supporting a window covering, the method comprising the steps of:

a. securing a coupling device to the end of the rod; and b. vertically suspending a pendant from the coupling device outwardly of the end of the rod and outwardly of an end of the window covering.

19. The method of claim 18, wherein step (a) includes at least one of pressing the coupling device into a press fit engagement with the end of the rod, tightening of a setscrew, actuating of a clamp, and applying of an adhesive.

20. The method of claim 18, wherein step (b) includes engaging a hook associated with one of the pendant and the coupling device with an eye associated with the other of the pendant and the coupling device.

21. The method of claim 18, further comprising the step of selecting at least one of a plurality of pendants of differing designs.

22. The method of claim 18, wherein the step of vertically suspending a pendent includes suspending the pendant in a first plane extending vertically through a longitudinal axis of the rod.

* * * * *